United States Patent [19]

Yoshida

[11] 4,375,019

[45] Feb. 22, 1983

[54] DEVICE FOR ADJUSTING POSITION OF DRIVE ELEMENT FOR OPENING AND CLOSING AUTOMATICALLY HORIZONTALLY OPENING AND CLOSING SLIDING DOOR

[75] Inventor: Kenji Yoshida, Tokyo, Japan

[73] Assignee: Solic Co., Ltd., Tokyo, Japan

[21] Appl. No.: 194,780

[22] Filed: Oct. 7, 1980

[51] Int. Cl.[3] ..... H01H 3/12; F05F 15/20

[52] U.S. Cl. ..... 200/52 R; 49/31; 200/61.42; 200/61.72

[58] Field of Search ..... 200/61.41, 61.42, 61.43, 200/61.71-61.75; 335/205-207; 49/26-28, 31, 32, 360; 74/89.2-89.22

[56] References Cited

U.S. PATENT DOCUMENTS 3,219,317 11/1965 Merker ..... 200/61.42
3,248,630 4/1966 Purdy ..... 200/47 X
3,553,890 1/1971 Stretton ..... 200/61.72 X
3,932,718 1/1976 Porat ..... 335/205 X

*Primary Examiner*—J. R. Scott
*Attorney, Agent, or Firm*—George B. Oujevolk

[57] ABSTRACT

A device for adjusting the position of a drive element for automatically opening and closing a sliding door which is automatically opened upon stepping on of a mat switch by a customer who intends to enter a store and is automatically closed upon releasing of the mat switch by the customer who entered the store. The drive element of the automatically opening and closing sliding door is adjusted by merely once manually opening and closing sliding door. The drive elements such as limit switches are slidably mounted, not on the sliding door but on an endless wire such as an endless belt. Thus, adjusting the drive element so that the sliding door may stop just upon completely opening or closing of the door when mounting such an automatic sliding door can be rapidly and readily accomplished.

3 Claims, 6 Drawing Figures

DEVICE FOR ADJUSTING POSITION OF DRIVE ELEMENT FOR OPENING AND CLOSING AUTOMATICALLY HORIZONTALLY OPENING AND CLOSING SLIDING DOOR

BACKGROUND OF THE INVENTION

This invention relates to a sliding door which is automatically opened upon stepping on of a mat switch by a customer who intends to enter a store or the like and is automatically closed upon releasing of the mat switch by the customer who entered the store and, more particularly, to a device for adjusting the position of a drive element for automatically opening and closing such a sliding door.

BRIEF DESCRIPTION OF THE PRIOR ART

The conventional automatically opening and closing sliding door of this type, as shown in FIG. 1, is opened when a motor a is energized upon stepping on a mat switch b by a customer. The motor a normally or reversely rotates an endless belt c through pulleys d, d'. The sliding door e is mounted via mounts f, f' on the endless belt c, and is thus opened or closed through the endless belt c by the motor a. In this case limit switches g, g' are attached at predetermined positions. On the other hand, drive elements h, h' for operating the limit switches g, g', respectively are mounted at the sliding door e side. When the sliding door e is opened or closed, the drive elements h, h' operate the limit switches g, g', respectively to thereby open or close the sliding door e and to then stop the opening or closing of the sliding door e at a suitable time.

In this construction of the sliding door one or both of the mounting positions of the limit switches g, g' and of the drive elements h, h' must be adjusted to stop the opening or closing sliding door at a suitable time. These adjusting means are actually very complicated. If the relative relationship between the stop of opening the sliding door and the stop of closing the sliding door is not quite correct, the sliding door does not completely close or remains half opened. Thus, the adjusting means takes considerable time to readjust and requires skill.

SUMMARY OF THE INVENTION

Accordingly, an object of this invention is to provide a device for adjusting the position of a drive element for automatically opening and closing a sliding door in which means for adjusting the drive element so that the sliding door may stop precisely upon completely opening or closing of the door when mounting such an automatic sliding door can be rapidly and readily set.

It is another object of this invention to provide a device for adjusting the position of a drive element for an automatically opening and closing sliding door which can adjust the drive element merely by someone manually opening and closing the sliding door.

It is still another object of this invention to provide a device for adjusting the position of a drive element for an automatically opening and closing sliding door which eliminates the conventional complicated adjusting means with screws at the mounting position of the drive element and the required skilfulness.

According to this invention, the drive element is adjusted once by merely manually opening and closing the sliding door using the slidably mounted drive elements for operating driven elements such as limit switches on an endless wire or an endless belt.

BRIEF DESCRIPTION OF THE DRAWINGS

The invention as well as other objects and advantages thereof will become more apparent from the following detailed description when taken together with the accompanying drawings, in which:

FIGS. 2A to 2C are front views of the essential portion of one preferred embodiment of the automatic opening and closing sliding door attached with the device for adjusting the position of the drive element for opening and closing the sliding door, wherein FIG. 2A shows the half opened state, FIG. 2B shows the fully closed state, and FIG. 2C shows fully opened state;

DESCRIPTION OF THE PREFERRED EMBODIMENT

Figure 1:
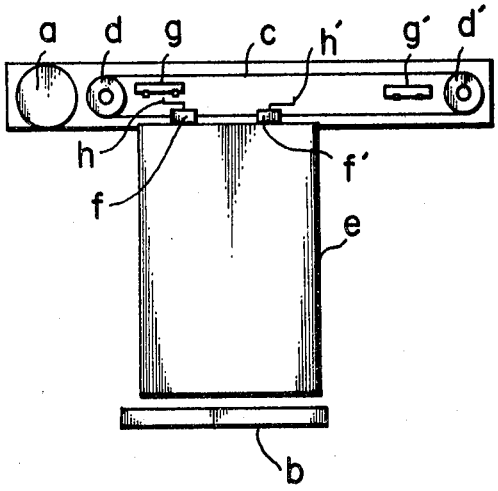
FIG. 1 PRIOR ART
FIG. 1 is a front view of the conventional automatic opening and closing sliding door which is illustrative of the prior art.

Reference is made to the drawings, particularly to FIGS. 2A through 2C to FIG. 4 showing one preferred embodiment of the device for adjusting the position of a drive element for automatically opening and closing a sliding door according to this invention, wherein like reference numerals designate the same parts.

The automatically horizontally sliding door 5 incorporates a device for adjusting the position of a drive element for opening and closing the sliding door, which device comprises an electric motor 2 energized by an electric controller 1 and installed on the top of an exit, an endless belt rotating mechanism 3 driven by the motor 2, a driven element 4 such as, for example, limit switches, lead switches or the like, and a guide rail 6 mounted to slide the sliding door 5 therealong. The endless belt rotating mechanism 3 consists of a pair of pulleys 3' and 3'', and an endless wire 7 such as a V-belt or the like engaged around the pulleys 3' and 3''. One of door wheel mounts 8, 8' fixedly secured to the sliding door 5 is secured to the endless wire 7 with a projection 8''.

The driven element 4 of the electric controller 1 consists of four reed switches 4', $4'_1$, $4_2$ and $4'_2$.

In the device for adjusting the position of the drive element for automatically opening and closing the sliding door, i.e., drive elements 9, 9' for closing the reed switches 4', $4'_1$, $4_2$ or $4'_2$ are slidably mounted on the endless wire 7, and a stopper 10 formed perpendicularly with the endless wire 7 is projected between the pulley 3' and the driven element 4 in such a manner that the endless wire 7 may pass grooves 11, 11' formed at the stopper 10 and that the drive elements 9, 9' may detachably contact the driven element 4 side of the stopper 10.

The drive elements 9, 9' each consists of a U-shaped frame 12 engaged with the endless wire 7, raised ends 13, 13 and 13', 13' which protrude obliquely upwardly and downwardly from the upper and lower walls, respectively of the frame 12 at both side ends, and actuators 14, 14' such as magnets. As particularly shown in FIG. 4, the drive elements 9, 9' are stopped at predetermined positions of the endless wire 7 by elastic means such as elastic piece 15 so that they may slidably move upon reception of more than predetermined external force.

Figure 2A:
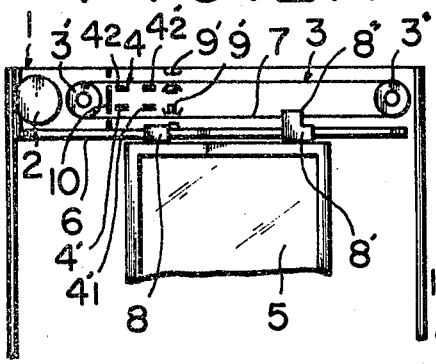
Figure 2B:
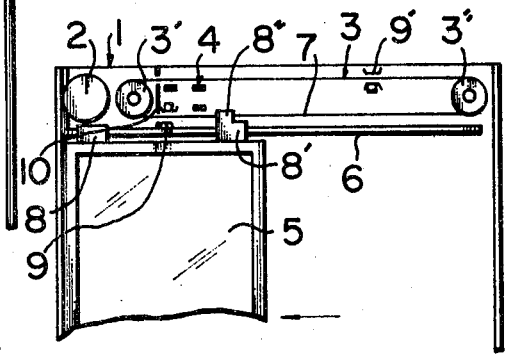

Operation of the device for adjusting the position of the drive element for opening and closing the sliding door so constructed will now be described. As shown in FIG. 2A, the drive elements 9, 9' are disposed at desired positions of the endless wire 7. When the sliding door 5 is manually moved from this state to the state that the sliding door 5 is completely closed as shown in FIG. 2B, the drive element 9 is brought into contact with the stopper 10 at this time. Thereafter, the drive element 9 slides along with the endless wire 7 and is not moved any more from that position but the sliding door 5 is completely closed.

At this time the drive element 9 operates the reed switch 4' of the drive element 4 to thereby open the reed switch 4' and to deenergize the motor 2. Thus, the correct relative position between the drive element 9 and the reed switch 4' is retained.

Figure 2C:
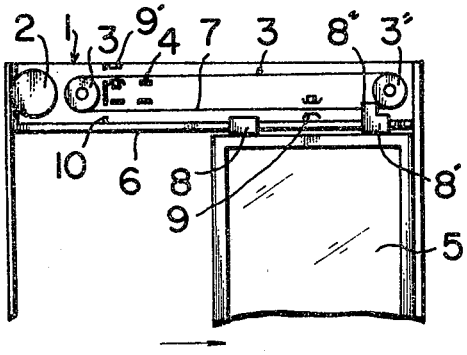
Figure 3:
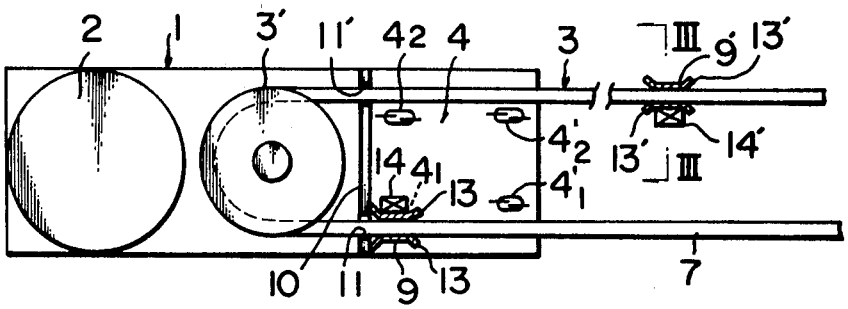
FIG. 3 is an enlarged front view of the essential portion shown in FIG. 2B for the purpose of explanation.
Figure 4:
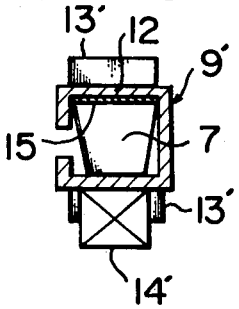
FIG. 4 is an enlarged longitudinal sectional side view of the essential portion taken along the line III—III in FIG. 3.

When the sliding door 5 is made to slide until the door 5 is completely opened as shown in FIG. 2C, the drive element 9' slides along with the endless wire 7, so that the element 9' remains in contact with the stopper 10. Thus, the drive element 9' operates the reed switch $4_2$ to thereby open the reed switch $4_2$ and to accordingly deenergize the motor 2.

The reed switches $4'_1$, $4'_2$ operate to decelerate the sliding speed of the sliding door 5 in response to the passage of the drive elements 9, 9'. It is noted that only one reed switch may also be employed instead of two as with the reed switches $4_1$, $4_2$ to operate both the drive elements 9, 9', and the reed switches $4'_1$, $4'_2$ may be eliminated.

It is to be observed therefore that the drive elements 9, 9' are slidably mounted along the endless wire 7 and the proper relative position between the driven element 4 and the drive elements 9, 9' can be adjusted by bringing the drive elements into contact with the stopper 10 manually by once opening and closing the sliding door 5 by hand. The adjusting of the device may be readily completed and thus eliminates the conventional complicated adjustments with screws at the mounting position of the drive member and the required skill.

What is claimed is:

1. A device for adjusting the opening and closing position of a sliding door by adjusting at least one drive element thereof, comprising in combination:

(a) guide rails (6) disposed above a defined door station for guiding a sliding door (5) therealong;

(b) an endless wire mechanism (3) driven by a motor (2) including controller means (1), said mechanism including endless means (7) extending across said door station held by pulleys along a travel path;

(c) driven element switch means (4) and at least one position adjustable drive element (9) mounted on said endless means (7), said drive element (9) having a U-shaped frame (12) protruding ends (13) with magnet means actuators (14) for enabling said driven element switch means (4) and elastic means (15) holding said drive element (9) to said endless wire mechanism (3) but permitting said drive element (9) to slide along said mechanism when the elastic force is overcome so that the drive element may be positioned at desired locations along said travel path, said drive element being adapted to enable said driven element switch means (4); and, (d) a stopper (10) along said travel path, said stopper (10) having grooves (11) so disposed as to stop said drive element (9) to contact the driven element switch means (4).

2. The device for adjusting the position of a drive element according to claim 1, wherein said driven element switch means consists of at least two reed switches, and said drive element opens the reed switches to deenergize the motor and to accordingly stop the drive element at a suitable position.

3. The device according to claim 1, wherein said stopper is formed perpendicularly with the endless wire mechanism, and is projected between the pulleys of said endless wire mechanism and the driven element switch means in such a manner that the endless wire may pass the grooves formed at said stopper.

* * * * *